US005536193A

United States Patent [19]

Kumar

[11] Patent Number: 5,536,193

[45] **Date of Patent: *Jul. 16, 1996**

[54] METHOD OF MAKING WIDE BAND GAP FIELD EMITTER

[75] Inventor: Nalin Kumar, Austin, Tex.

[73] Assignee: Microelectronics and Computer Technology Corporation, Austin, Tex.

[ * ] Notice: The term of this patent shall not extend beyond the expiration date of Pat. No. 5,199,918.

[21] Appl. No.: 264,386

[22] Filed: Jun. 23, 1994

Related U.S. Application Data

[60] Continuation-in-part of Ser. No. 981,958, Nov. 24, 1992, Pat. No. 5,341,063, which is a division of Ser. No. 789,237, Nov. 7, 1991, Pat. No. 5,199,918.

[51] Int. Cl.[6] ..... H01J 9/02

[52] U.S. Cl. ..... 445/50

[58] Field of Search ..... 445/24, 50, 58

[56] References Cited

U.S. PATENT DOCUMENTS

| | | | |
|---|---|---|---|
| 2,959,704 | 11/1960 | Snell, Jr. et al. | 313/309 |
| 3,259,782 | 7/1966 | Shroff | 313/336 |
| 3,665,241 | 5/1972 | Spindt et al. | 313/351 |
| 3,675,063 | 7/1972 | Spindt et al. | 313/104 |
| 3,755,704 | 8/1973 | Spindt et al. | 313/309 |
| 3,812,559 | 5/1974 | Spindt et al. | 445/52 |
| 3,855,499 | 12/1974 | Yamada et al. | 313/351 X |
| 3,894,332 | 7/1975 | Nathanson et al. | 313/336 |
| 3,947,716 | 3/1976 | Fraser, Jr. et al. | 313/336 |
| 3,970,887 | 7/1976 | Smith et al. | 313/309 |
| 3,998,678 | 12/1976 | Fukase et al. | 156/3 |

(List continued on next page.)

FOREIGN PATENT DOCUMENTS

| | | |
|---|---|---|
| 8807288 | 12/1989 | France . |
| 57-141480 | 9/1982 | Japan . |
| 57-141482 | 9/1982 | Japan . |
| 62-027486 | 2/1987 | Japan . |
| 62-121783 | 6/1987 | Japan . |
| 63-251491 | 10/1988 | Japan . |
| 64-043595 | 2/1989 | Japan . |
| 3-137190 | 6/1991 | Japan . |
| 4-202493 | 7/1992 | Japan . |
| 4-227678 | 8/1992 | Japan . |
| 4-227785 | 8/1992 | Japan . |
| 4-233991 | 8/1992 | Japan . |
| 4-230996 | 8/1992 | Japan . |
| 4-270783 | 9/1992 | Japan . |
| 5-065478 | 3/1993 | Japan . |
| 5-117653 | 5/1993 | Japan . |

OTHER PUBLICATIONS

Maissel and Glang, *Handbook of Thin Film Technology,* 1983 Reissue, Chapters 8 and 10, McGraw–Hill, New York, N.Y.

Cade and Lee, "Vacuum Microelectronics", *GEC J. Res. Inc.,* Marconi Rev., 7(3), 129 (1990).

Geis et al., "Diamond Cold Cathode," *IEEE Electron Device Letters,* vol. 12, No. 8, Aug. 1991, pp. 456–459.

Geis et al., "Diamond Cold Cathodes," Applicaitons of Diamond Films and Related Materials, Tzeng et al. (Editors), Elsevier Science Publishers B. V., 1991 pp. 309–310.

Eibl *Journal Materials Research,* vol. 5, No. 11, Nov. 1990. pp. 2620–2745.

(List continued on next page.)

*Primary Examiner*—Kenneth J. Ramsey

*Attorney, Agent, or Firm*—Winstead Sechrest & Minick

[57] ABSTRACT

A field emitter comprising an exposed wide band gap emission area in contact with and protruding from a planar surface of a conductive metal, and a method of making is disclosed. Suitable wide band gap materials (2.5–7.0 electron-volts) include diamond, aluminum-nitride and gallium-nitride; suitable conductive metals include titanium, tungsten, gold and graphite. The method includes disposing the wide band gap material on a substrate, disposing the conductive metal on the wide band gap material, and etching the conductive metal to expose wide band gap emission areas. The emission areas are well suited for large area flat panel displays.

22 Claims, 6 Drawing Sheets

U.S. PATENT DOCUMENTS

| | | | |
|---|---|---|---|
| 4,008,412 | 7/1977 | Yuito et al. | 313/309 |
| 4,075,535 | 2/1978 | Genequand et al. | 313/422 |
| 4,084,942 | 4/1978 | Villalobos | 51/307 |
| 4,139,773 | 2/1979 | Swanson | 250/423 |
| 4,141,405 | 2/1979 | Spindt | 164/46 |
| 4,143,292 | 3/1979 | Hosoki et al. | 313/336 |
| 4,164,680 | 8/1979 | Villalobos | 313/336 |
| 4,168,213 | 9/1979 | Hoeberechts | 204/15 |
| 4,178,531 | 12/1979 | Alig | 313/309 X |
| 4,307,507 | 12/1981 | Gray et al. | 29/580 |
| 4,350,926 | 9/1982 | Shelton | 313/455 |
| 4,498,952 | 2/1985 | Christensen | 156/643 |
| 4,507,562 | 3/1985 | Gasiot et al. | 250/484.1 |
| 4,513,308 | 4/1985 | Greene et al. | 313/309 X |
| 4,528,474 | 7/1985 | Kim | 445/50 X |
| 4,540,983 | 9/1985 | Morimoto et al. | 340/772 |
| 4,542,038 | 9/1985 | Odaka et al. | 427/68 |
| 4,578,614 | 3/1986 | Gray et al. | 313/309 |
| 4,588,921 | 5/1986 | Tischer | 313/496 |
| 4,594,527 | 6/1986 | Genevese | 313/493 |
| 4,663,559 | 5/1987 | Christensen | 313/336 |
| 4,684,353 | 8/1987 | deSouza | 445/51 |
| 4,684,540 | 8/1987 | Schulze | 427/71 |
| 4,685,996 | 8/1987 | Busta et al. | 156/628 |
| 4,687,825 | 8/1987 | Sagou et al. | 427/71 X |
| 4,687,938 | 8/1987 | Tamura et al. | 250/423 |
| 4,710,765 | 12/1987 | Ohkoshi et al. | 340/781 |
| 4,721,885 | 1/1988 | Brodie | 313/309 X |
| 4,728,851 | 3/1988 | Lambe | 313/309 |
| 4,758,449 | 7/1988 | Kimura et al. | 427/71 X |
| 4,763,187 | 8/1988 | Biberian | 313/309 X |
| 4,788,472 | 11/1988 | Katakami | 313/496 |
| 4,816,717 | 3/1989 | Harper et al. | 313/509 X |
| 4,822,466 | 4/1989 | Rabalais et al. | 204/192.15 |
| 4,835,438 | 5/1989 | Baptist et al. | 313/309 |
| 4,851,254 | 7/1989 | Yamamoto et al. | 427/450 |
| 4,855,636 | 8/1989 | Busta et al. | 313/306 |
| 4,857,161 | 8/1989 | Borel et al. | 204/192.26 |
| 4,857,799 | 8/1989 | Spindt et al. | 313/495 |
| 4,874,981 | 10/1989 | Spindt | 313/309 |
| 4,882,659 | 11/1989 | Gloudemans | 362/61 |
| 4,889,690 | 12/1989 | Opitz et al. | 422/73 |
| 4,892,757 | 1/1990 | Kasenga et al. | 427/215 |
| 4,899,081 | 2/1990 | Kishino et al. | 313/496 |
| 4,908,539 | 3/1990 | Meyer | 315/169.1 |
| 4,923,421 | 5/1990 | Brodie et al. | 445/24 |
| 4,926,056 | 5/1990 | Spindt | 313/230 |
| 4,933,108 | 6/1990 | Soredal | 252/518 |
| 4,940,916 | 7/1990 | Borel et al. | 313/309 X |
| 4,943,343 | 7/1990 | Bardai et al. | 156/643 |
| 4,956,202 | 9/1990 | Kasenga et al. | 427/215 |
| 4,964,946 | 10/1990 | Gray et al. | 156/643 |
| 4,987,007 | 1/1991 | Wagal et al. | 427/53.1 |
| 4,990,766 | 2/1991 | Simms et al. | 313/336 |
| 4,994,205 | 2/1991 | Bryan et al. | 252/301.4 F |
| 5,015,912 | 5/1991 | Spindt et al. | 313/309 X |
| 5,019,003 | 5/1991 | Chason | 445/24 |
| 5,036,247 | 7/1991 | Watanabe et al. | 313/496 |
| 5,038,070 | 8/1991 | Bardai et al. | 313/309 |
| 5,054,046 | 10/1991 | Shoulders | 313/306 |
| 5,054,047 | 10/1991 | Shoulders | 313/306 X |
| 5,055,744 | 10/1991 | Tsuruoka | 313/497 X |
| 5,063,323 | 11/1991 | Longo et al. | 313/309 |
| 5,063,327 | 11/1991 | Brodie et al. | 313/482 |
| 5,064,396 | 11/1991 | Spindt | 445/50 |
| 5,075,591 | 12/1991 | Holmberg | 313/309 X |
| 5,085,958 | 2/1992 | Jeong | 430/25 |
| 5,089,292 | 2/1992 | MaCaulay et al. | 427/78 |
| 5,089,742 | 2/1992 | Kirkpatrick et al. | 313/351 |
| 5,089,812 | 2/1992 | Fuse | 345/89 |
| 5,090,932 | 2/1992 | Dieumegard et al. | 445/24 |
| 5,098,737 | 3/1992 | Collins et al. | 427/53.1 |
| 5,101,288 | 3/1992 | Ohta et al. | 359/54 |
| 5,103,144 | 4/1992 | Dunham | 313/336 X |
| 5,103,145 | 4/1992 | Doran | 313/309 X |
| 5,117,267 | 5/1992 | Kimoto et al. | 357/16 |
| 5,117,299 | 5/1992 | Kondo et al. | 359/58 |
| 5,119,386 | 6/1992 | Narusawa | 357/16 |
| 5,123,039 | 6/1992 | Shoulders | 313/306 X |
| 5,124,072 | 6/1992 | Dole et al. | 252/301.4 F |
| 5,124,558 | 6/1992 | Soltani et al. | 250/484.1 |
| 5,129,850 | 7/1992 | Kane et al. | 445/508 |
| 5,132,585 | 7/1992 | Kane et al. | 313/44 |
| 5,132,676 | 7/1992 | Kimura et al. | 359/58 X |
| 5,138,237 | 8/1992 | Kane et al. | 315/349 |
| 5,141,459 | 8/1992 | Zimmerman | 445/50 X |
| 5,141,460 | 8/1992 | Jaskie et al. | 445/508 |
| 5,142,184 | 8/1992 | Kane | 313/309 |
| 5,142,390 | 8/1992 | Ohta et al. | 359/58 |
| 5,148,461 | 9/1992 | Shoulders | 313/306 X |
| 5,150,011 | 9/1992 | Fujieda | 315/169.4 |
| 5,151,061 | 9/1992 | Sandhu | 445/50 X |
| 5,153,753 | 10/1992 | Ohta et al. | 359/58 |
| 5,153,901 | 10/1992 | Shoulders | 313/306 X |
| 5,157,309 | 10/1992 | Parker et al. | 313/309 X |
| 5,162,704 | 11/1992 | Kobori et al. | 313/309 X |
| 5,166,456 | 11/1992 | Yoshino | 252/301.4 S |
| 5,180,591 | 1/1993 | Dworsky et al. | 313/355 X |
| 5,183,529 | 2/1993 | Potter et al. | 156/613 |
| 5,186,670 | 2/1993 | Doan et al. | 445/50 X |
| 5,194,780 | 3/1993 | Meyer | 313/309 X |
| 5,199,917 | 4/1993 | MacDonald et al. | 445/50 |
| 5,199,918 | 4/1993 | Kumar | 445/50 |
| 5,202,571 | 4/1993 | Hirabayashi et al. | 313/446 X |
| 5,203,731 | 4/1993 | Zimmerman | 445/24 |
| 5,204,021 | 4/1993 | Dole | 252/301.4 H |
| 5,204,581 | 4/1993 | Andreadakis et al. | 313/309 X |
| 5,210,430 | 5/1993 | Taniguchi et al. | 313/509 X |
| 5,212,426 | 5/1993 | Kane | 313/309 X |
| 5,213,712 | 5/1993 | Dole | 252/301.4 R |
| 5,214,416 | 5/1993 | Kondo et al. | 340/766 |
| 5,228,877 | 7/1993 | Allaway et al. | 445/50 |
| 5,228,878 | 7/1993 | Komatsu | 445/24 |
| 5,229,331 | 7/1993 | Doan et al. | 437/228 |
| 5,229,682 | 7/1993 | Komatsu | 313/309 |
| 5,235,244 | 8/1993 | Spindt | 313/309 X |
| 5,242,620 | 9/1993 | Dole et al. | 252/301.4 R |
| 5,243,252 | 9/1993 | Kaneko et al. | 313/309 |
| 5,250,451 | 10/1993 | Chouan | 437/40 |
| 5,252,833 | 10/1993 | Kane et al. | 250/423 F |
| 5,256,888 | 10/1993 | Kane | 313/309 X |
| 5,259,799 | 11/1993 | Doan et al. | 455/50 X |
| 5,275,967 | 1/1994 | Taniguchi et al. | 437/127 |
| 5,276,521 | 1/1994 | Mori | 348/243 |
| 5,277,638 | 1/1994 | Lee | 445/50 X |
| 5,278,475 | 1/1994 | Jaskie et al. | 315/169.3 |
| 5,281,891 | 1/1994 | Kaneko et al. | 313/309 |
| 5,283,500 | 2/1994 | Kochanski | 313/309 X |
| 5,285,129 | 2/1994 | Takeda et al. | 313/309 X |
| 5,302,423 | 4/1994 | Tran et al. | 427/555 |
| 5,312,514 | 5/1994 | Kumar | 156/643 |
| 5,380,546 | 1/1995 | Kirshnan et al. | 427/126.1 |
| 5,399,238 | 3/1995 | Kumar | 313/309 |

OTHER PUBLICATIONS

Noer, "Electron Field Emission from Broad–Area Electrodes", *Applied Physics* A 28, 1982, pp. 1–24.

Avakyan, et al., "Angular Characteristics of the Radiation by Ultrarelativistic Electrons in Thick Diamond Single Crystals", *Soviet Technical Physics Letters*, vol. 11, No. 11, Nov. 1985, pp. 574–575.

Djubua, et al., "Emission Properties of Spindt–Type Cold Cathodes with Different Emission Cone Material", *IEEE Transactions on Electron Devices*, vol. 38, No. 10, Oct. 1991.
Wang, et al., "Cold Field Emission from CVD Diamond Films Observed in Emission Electron Microscopy", *Electronics Letters*, vol. 27, No. 16, Aug. 1991.
Yoder, "Applications of Diamond and Related Materials", *5th Annual Diamond Technology Workshop*, Troy, MI, May 18–20, 1994.
Davis, "Growth and Characterization of III–V Nitride Thin Films via Plasma–Ion–assisted Gas/source Molecular Beam Epitaxy", *5th Annual Diamond Technology Workshop*, Troy, MI, May 18–20, 1994.
Rubin et al., "P—Type Gallium Nitride by Reactive Ion–Beam Molecular Beam Epitaxy with Ion Implantation, Diffusion or Coevaporation of Mg", pre–printed by Lawrence Berkeley Laboratory, University of California, Berkeley, CA, Mar. 1994, pp. 1–7.
Newman et al., "Thermodynamics and Kinetic Processes Involved in the Growth of Epitaxial GaN Thin Films", *Applied Physics Letters*, 62(11), 15 Mar. 1993, pp. 1242–1244.
Wehner "Cone Formation as a Result of Whisker Growth on Ion Bombarded Metal Surfaces", *J. Vac. Sci. Techol.* A 3(4), Jul./Aug. 1985, pp. 1821–1834.
Werner et al "Cone Formation on Metal Targets During Sputtering," *J. Appl. Physics*, vol. 42, No. 3, Mar. 1, 1971, pp. 1145–1149.
Warren "Control of Silicon Field Emitter Shaper with Isotrophically Etched Oxide Masks," Dec. 1989.
Spinot et al "Physical Properties of Thin Film Field Emission Cathodes," *J. Appl. Phys.*, vol. 47, 1976, p. 5248.
"Topography: Texturing Effects," *Handbook of Ion Beam Processing Technology*, No. 17, pp. 338–361.
Muller et al "A Comparative Study of Deposition of Thin Films by Laser Induced PVD with Femtosecond and Nanosecond Laser Pulses," *SPIE* , vol. 1858 (1993), pp. 464–475.
Davanloo et al "Amorphic Diamond Films Produced by a Laser Source," *Journal Appl. Physics*, vol. 67, No. 4, Feb. 15, 1990, pp. 2081–2087.
Pappas et al "Characterization of Laser Vaporization Plasmas Generated for the Deposition of Diamond–Like Carbon," *J. appl. Phys.*, vol. 72, No. 9. Nov. 1, 1992, pp. 3966–3970.
Marquardt et al "Deposition of Amorphous Carbon Films from Laser–Produced Plasmas," *Mat. Res. Soc. Sump. Proc.*, vol. 38, (1985), pp. 326–335.
Kumar et al "Development of Nano–Crystaline Diamond–Based–Emission Displays," *Society of Information Display Conference Technical Digest*, 1994, pp. 43–45.
Wagel et al "Diamond–like Carbon Films Prepared with a Laser Ion Source," *Appl. Phys. Lett.*, vol. 53, No. 3, Jul. 18, 1988, pp. 187–188.
Chen et al "Emission Spectroscopy During Excimer Laser Albation of Graphite," *Appl. Phys. Letters*, vol. 57, No. 21, Nov. 1990, pp. 2178–2180.
Hastie et al "Laser Ablation in Materials Processing: Fundamentals and Applications," *Mat. Res. Soc. Symp. Proc.* vol. 285, (Dec. 1, 1992), pp. 39–86.
Collins et al "Laser Plasma Source of Amorphic Diamond," *Appl, Phys. Lett.*, vol. 54, No. 3, Jan. 16, 1989, pp. 216–218.
Schnenck et al "Optical Characterization of Thin Film Laser Deposition Processes," *SPIE*, vol. 1594, *Process Module Metrology, Control, and Clustering* (1991), pp. 411–417.
Chen et al "Optical Emission Diagnostics of Laser–Induced Plasma for Diamond–Like Film Deposition," *Appl. Phys.*, vol. 51A, 1991, pp. 328–334.
Tasaka et al "Optical Observation of Plumes Formed at Laser Ablation of Carbon Materials," *Appl. Surface Science*, vol. 79/80, 1994, pp. 141–145.
Gorbunov et al "Spatial Characteristics of Laser Pulsed Plasma Deposition of Thin Films," *SPIE*, vol. 1352, *Laser Surface Microprocessing* (1989), pp. 95–99.
Collins et al "The bonding of Protective Films of Amorphic Diamond to Titanium," *J. Appl. Phys.*, vol. 71, No. 7, Apr. 1, 1992, pp. 3260–3265.
Hastie et al "Thermochemistry of Materials by Laser Vaporization Mass Spectrometry: 2. Graphite," *High Temperatures–High Pressures*, vol. 20, 1988, pp. 73–89.
"Electron Field Emission from Amorphic Diamond Thin Films," *6th International Vacuum Microelectronic Conference Technical Digest*, 1993, pp. 162–163.
Hastie "High Temperature Chemistry in Laser Plumes," John L. Margrave Research Symposium, Rice University, Apr. 28, 1994.
Bajic et al "Enhanced Cold–Cathode Emission Using Composite Resin–Carbon Coatings," Dept of Electronic Eng. & Applied Physics, Aston Univ., Aston Triangle Birmingham B4 7ET, UK, May 29, 1987.
Kumar et al "Field Emission Displays Based on Diamond Thin Films," *Society of Information Display Conference Technical Digest*, 1993, pp. 1009–1010.
Collins et al "Microstructure of Amorphic Diamond Films".
Meyer "Recent Development on 'Microtips° Display at LETI," *Technical Digest of IUMC 91, Nagahama 1991, pp. 6–9.*
Collins et al "Thin–Film Diamond," *The Texas Journal of Science*, vol. 41, No. 4, 1989, pp. 343–358.
Xie et al "Use of Diamond Thin Films for Low Cost field Emissions Displays," *7th International Vacuum Microelectronics Conference Technical Digest*, 1994, pp. 229–232.
Data Sheet on Anode Drive SN755769, Texas Instruments, pp. 4–81 to 4–88.
Data Sheet on Display Driver, HV38, Supertex, Inc. pp. 11–43 to 11–50.
Data Sheet on Voltage Driver, HV620, Supertex Inc., pp. 1–6, May 21, 1993.
Data Sheet on Voltage Drive, HV 622, Supertex Inc., pp. 1–5, Sep. 22, 1992.

METHOD OF MAKING WIDE BAND GAP FIELD EMITTER

CROSS-REFERENCE TO RELATED APPLICATIONS

This is a continuation-in-part of U.S. application Ser. No. 07/981,958 filed Nov. 24, 1992, issued as U.S. Pat. No. 5,341,063; which is a divisional of U.S. application Ser. No. 07/789,237 filed Nov. 7, 1991, issued as U.S. Pat. No. 5,199,918. Such applications and the disclosures therein are incorporated by reference.

BACKGROUND OF THE INVENTION

1. Field of the Invention

The invention relates to field emitters, and more particularly to exposed wide band gap field emission areas and a method of making same.

2. Description of Related Art

Field emitters are widely used as sources of electrons in lamps and scanning electron microscopes since emission is affected by the adsorbed materials. Field emitters have also been found useful in flat panel displays and vacuum microelectronics applications. Cold cathode and field emission based flat panel displays have several advantages over other types of flat panel displays, including low power dissipation, high intensity and low projected cost. Thus, an improved field emitter and any process which reduces the complexity of fabricating field emitters is clearly useful.

The present invention can be better appreciated with an understanding of the related physics. General electron emission can be analogized to the ionization of a free atom. Prior to ionization, the energy of electrons in an atom is lower than electrons at rest in a vacuum. In order to ionize the atom, energy must be supplied to the electrons in the atom. That is, the atom fails to spontaneously emit electrons unless the electrons are provided with energy greater than or equal to the electrons at rest in the vacuum. Energy can be provided by numerous means, such as by heat or irradiation with light. When sufficient energy is imparted to the atom, ionization occurs and the atom releases one or more electrons.

Several types of electron emission are known. Thermionic emission involves an electrically charged particle emitted by an incandescent substance (as in a vacuum tube or incandescent light bulb). Photoemission releases electrons from a material by means of energy supplied by incidence of radiation, especially light. Secondary emission occurs by bombardment of a substance with charged particles such as electrons or ions. Electron injection involves the emission from one solid to another. Finally, field emission refers to the emission of electrons due to an electric field.

In field emission (or cold emission), electrons under the influence of a strong electric field are liberated out of a substance (usually a metal or semiconductor) into a dielectric (usually a vacuum). The electrons "tunnel" through a potential barrier instead of escaping "over" it as in thermionics or photoemission. Field emission is therefore a quantum-mechanics phenomena with no classical analog. A more detailed discussion of the physics of field emission can be found in U.S. Pat. No. 4,663,559 to Christensen; Cade and Lee, "Vacuum Microelectronics", *GEC J. Res. Inc.*, Marconi Rev., 7(3), 129 (1990); and Cutler and Tsong, *Field Emission and Related Topics* (1978).

The shape of a field emitter affects its emission characteristics. Field emission is most easily obtained from sharply pointed needles or tips whose ends have been smoothed into a nearly hemispherical shape by heating. Tip radii as small as 100 nanometers have been reported. As an electric field is applied, the electric lines of force diverge radially from the tip and the emitted electron trajectories initially follow these lines of force. Field emitters with such sharp features similar to a "Spindt cathode" have been previously invented. An overview of vacuum electronics and Spindt type cathodes is found in the November and December, 1989 issues of *IEEE Transactions of Electronic Devices.* Fabrication of such fine tips, however, normally requires extensive fabrication facilities to finely tailor the emitter into a conical shape. Further, it is difficult to build large area field emitters since the cone size is limited by the lithographic equipment. It is also difficult to perform fine feature lithography on large area substrates as required by flat panel display type applications. Thus, there is a need for a method of making field emitters with fine conical or pyramid shaped features without the use of lithography.

The work function of the electron emitting surface or tip of a field emitter also effects emission characteristics. The work function is defined as the difference in energies of the Fermi level and vacuum level. A smaller work function requires lower voltage to emit electrons from a surface. In a metal, the Fermi level is the same as the conduction band. In wide band gap materials, however, the Fermi level lies between the conduction band and the valence band. In such a case, the work function of the material changes as the Fermi level changes due to doping or defects. Further, the energy difference between the conduction band and vacuum level is a fundamental material property referred to as electron affinity. Thus, the work function and electron affinity are the same in a metal, but different in a wide band gap material. Recently, several wide band gap semiconductors (insulators at room temperature) such as diamond and aluminum-nitride have been shown to have negative electron affinity as well. See, for example, Yoder, "Applications of Diamond and Related Materials", *5th Annual Diamond Technology Workshop,* Troy, Mich., May 18–20, 1994; Davis, "Growth and Characterization of III–V Nitride Thin Films via Plasma-and Ion-assisted Gas-source Molecular Beam Epitaxy", *5th Annual Diamond Technology Workshop,* Troy, Mich., May 18–20, 1994; Rubin et al., "P-Type Gallium Nitride by Reactive Ion-Beam Molecular Beam Epitaxy with Ion Implantation, Diffusion or Coevaporation of Mg", pre-print by Lawrence Berkeley Laboratory, University of California, Berkeley, Calif., March 1994, pp. 1–7; and Newman et al., "Thermodynamic and Kinetic Processes Involved in the Growth of Epitaxial GaN Thin Films", *Applied Physics Letters,* 62 (11), 15 March 1993, pp. 1242–1244.

There are other materials which exhibit low or negative electron affinity, but almost all of these materials are alkali metal based. Alkali metals are quite sensitive to atmospheric conditions and tend to decompose when exposed to air or moisture. Additionally, alkali metals have low melting points, typically below 1000° C., which may be unsuitable in certain applications.

For a full understanding of the prior art related to the present invention, certain attributes of diamond must also be discussed. Recently, it has been experimentally confirmed that the (111) surface of diamond crystal has an electron affinity of –0.7+/–0.5 electron-volts, showing it to possess negative electron affinity. A common conception about diamonds is that they are very expensive to fabricate. This is not always the case, however. Newly invented plasma chemical vapor deposition processes appear to be promising ways to bring down the cost of producing high quality diamond thin films. For instance, high fidelity audio speakers with diamond thin films as vibrating cones are already commercially available. It should also be noted that diamond thin films cost far less than the high quality diamonds used in jewelry.

Diamond cold cathodes have been reported by Geis et al. in "Diamond Cold Cathode", *IEEE Electron Device Letters,* Vol. 12, No. 8, August 1991, pp. 456–459; and in "Diamond Cold Cathodes", *Applications of Diamond Films and Related Materials,* Tzeng et al. (Editors), Elsevier Science Publishers B.V., 1991, pp. 309–310. The diamond cold cathodes are formed by fabricating mesa-etched diodes using carbon ion implantation into p-type diamond substrates. Geis et al. indicate that the diamond can be doped either n- or p-type. In fact, several methods show promise for fabricating n-type diamond, such as bombarding the film with sodium, nitrogen or lithium during growth. However, in current practice it is extremely difficult to fabricate n-type diamond and efforts for n-type doping usually result in p-type diamond. Furthermore, p-type doping fails to take full advantage of the negative electron affinity effect, and pure or undoped diamond is insulating and normally charges up to prevent emission.

There exists a need for improved methods of making field emission areas as well as improved field emitter structures using diamond and other wide band gap materials.

SUMMARY OF THE INVENTION

The present invention field emitter includes an exposed wide band gap emission area in contact with and protruding from a substantially planar surface of a conductive metal. Suitable wide band gap materials include diamond, aluminum-nitride and gallium-nitride; suitable conductive metals include titanium, tungsten, gold and graphite. The fabrication method includes disposing the wide band gap material on a substrate, disposing the conductive metal on the wide band gap material, and etching the conductive metal to expose wide band gap emission areas. The emission areas are well suited for large area flat panel displays.

The wide band gap material of the present invention may be deposited on the substrate either as a continuous film or as a powder, followed by depositing a layer of conductive metal over the wide band gap material. Alternatively, particles of the wide band gap material and the conductive metal can be mixed in a liquid to form a colloidal solution, the solution can be coated on the substrate and then the liquid can be removed. In either case, an etch is applied to remove conductive metal thereby exposing wide band gap emission areas which contact and protrude from a substantially planar surface of the conductive metal. If desired an anneal is applied (before or after the etch) to create or enhance a low resistance electrical contact between the wide band gap material and the conductive metal.

The present invention utilizes the extraordinary properties of wide band gap materials to provide a thermally stable emission area for a field emitter.

An object of the present invention is a process for fabricating large area field emitters with sub-micron features without requiring photolithography.

Another object of the present invention is to provide a field emitter which requires only a relatively small voltage for field emission to occur.

Still another object of the present invention is a process for fabricating field emitters which uses relatively few steps.

These and other objects, features and advantages of the present invention will be further described and more readily apparent from a review of the detailed description and preferred embodiments which follow.

BRIEF DESCRIPTION OF THE DRAWINGS

The following detailed description of the preferred embodiments can best be understood when read in conjunction with the following drawings, wherein.

DETAILED DESCRIPTION OF THE PREFERRED EMBODIMENTS

Figure 1A:
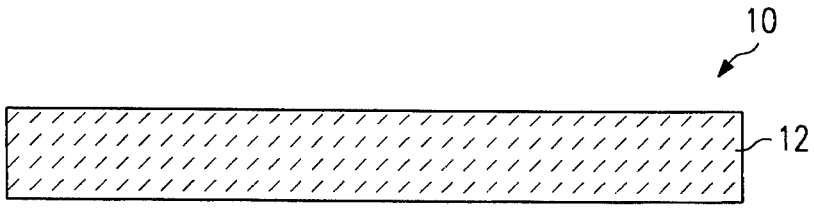
FIGS. 1A–1E show cross-sectional views of successive stages of fabricating a field emitter in accordance with one embodiment of the present invention.

While the embodiments illustrated herein disclose diamond emission areas, it is understood that the emission areas of the present invention can be formed from other wide band gap materials, such as aluminum-nitride or gallium-nitride. In wide band gap materials of the present invention, the band gap (the distance between the conduction band and valence band) is preferably in the range of approximately 2.5 to 7.0 electron volts.

Referring now to the drawings wherein depicted elements are not necessarily shown to scale and wherein like or similar elements are designated by the same reference numeral through the several views, and more particularly to FIGS. 1A–1E, there are shown successive cross-sectional views of a field emitter generally designated 10 according to a first embodiment of the invention.

With reference now to FIG. 1A, a substrate 12 is provided. Substrate 12 is preferably a flat large area substrate composed of glass or quartz, although other materials such as silicon, polymers or metals can be used. Substrate 12 provides a base upon which emission areas can be fabricated.

Figure 1B:
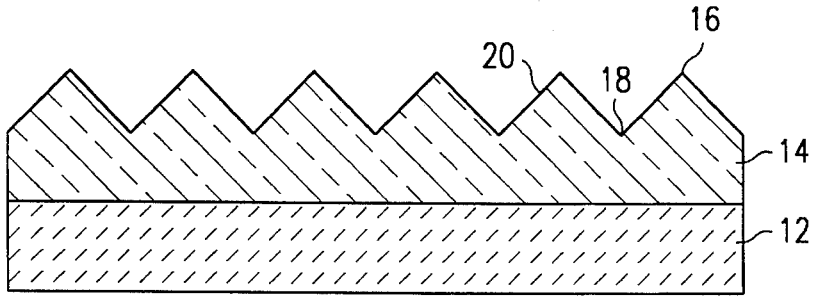

Referring now to FIG. 1B, a thin continuous film of diamond 14, preferably with low or negative electron affinity is coated on substrate 12. Diamond 14 forms a film preferably 500 to 5,000 angstroms thick which precludes the use of natural diamond. Further, diamond 14 is undoped and insulating. The preferred method of coating the thin diamond film is by chemical vapor deposition (CVD) but other methods such as sputtering, laser deposition and ion beam deposition are also suitable. The raw materials for diamond CVD are a hydrocarbon (usually methane ($CH_4$)) and hydrogen, and diamond CVD systems are similar to standard silicon oxide CVD systems. During CVD the combination of high temperature and plasma decomposes the hydrocarbon gas and activates high energy carbon atoms.

The high energy carbon atoms bombard substrate 12 and form a carbon film thereon. In addition, the high energy bombardment causes the lattice configuration of the deposited carbon atoms to change. Various carbon lattice structures, while composed of the same material, form highly differing structures, such as carbon soot, graphite, and diamond. In this embodiment, the deposited carbon atoms are bonded to four other carbon atoms. This lattice forms a diamond film on the substrate. Further details about depositing diamond films can be found in the Journal of Materials Research, Vol. 5, No. 11, Nov. 1990; and U.S. Pat. Nos. 5,098,737 and 4,987,007; each of which is incorporated herein by reference. The use of diamond (amorphic or nanocrystalline) as a low work function material (less than 4.5 electron-volts) in field emitters is also known in the art; see, for instance, U.S. Pat. Nos. 5,199,918; 5,180,951; and 5,141,460; as well as U.S. application Ser. Nos. 08/147,700 filed Nov. 04, 1993; Ser. No. 08/071,157 filed Sep. 2, 1993; Ser. No. 07/995,846 filed Dec. 23. 1992; Ser. No. 07/993,863 filed Dec. 23, 1992; and Ser. No. 07/851,701 filed Mar. 16, 1992; each of which is incorporated herein by reference.

Diamond films can assume several orientations, such as (100), (110) and (111). The preferred orientation for diamond 14 is (111) for several reasons. The (111) orientation provides the sharpest vertical features, shown as spikes 16 surrounded by valleys 18 on top surface 20 of diamond 14. The (111) orientation also grows the fastest in the vertical direction. Moreover, it has been experimentally confirmed that the (111) surface of diamond has a negative electron affinity in the range of −1.2 to −0.2 electron-volts. Nonetheless, other orientations of diamond can be used provided the diamond contains an uneven (nonplanar) exposed top surface. The desired orientation of diamond can be obtained by applying the appropriate temperature during CVD.

The thermal conductivity of the diamond film is relatively high, for instance at least five times that of copper. However, since the diamond film contains more defects than natural diamond, the thermal conductivity of the diamond film is approximately less than half that of natural diamond. An optional adhesion layer (not shown) such as 500 angstroms titanium, chromium, tantalum, titanium-tungsten or nickel-chromium can be sandwiched between substrate 12 and diamond 14.

It is understood that diamond or other wide band gap material may be deposited on substrate 12 by any number of techniques, including sputtering, evaporation (including magnetically filtered cathode arc evaporation), laser deposition or chemical vapor deposition. The preferred technique depends on the particular material. The preferred deposition techniques for diamond films are disclosed in U.S. Pat. Nos. 5,098,737 and 4,987,007.

It is further understood that although diamond 14 is shown as deposited on a relatively flat substrate, this need not be the case. In some applications, it may be preferable to deposit the diamond on microtips. A method of making high-density microtips using randomly dispersed nuclei as an etch mask, thereby avoiding photolithography, is disclosed in U.S. Pat. No. 5,312,514.

Figure 1C:
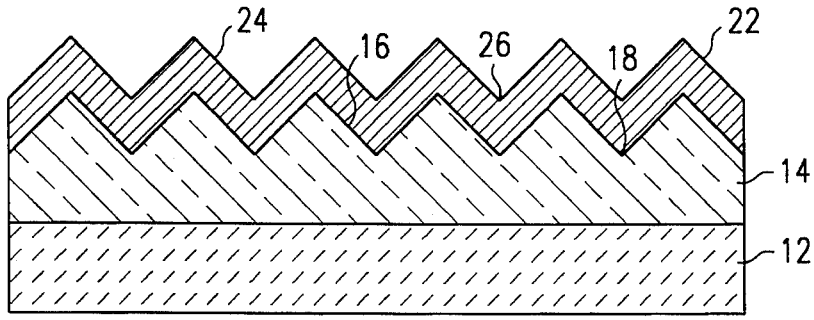

Referring now to FIG. 1C, a conductive metal is deposited over the diamond film. Sputtering and evaporation (including magnetically filtered cathode arc evaporation) are the preferred deposition techniques, with sputtering most preferred due to the low contamination and high integrity of the deposited metal. Further details of thin film technology are well known in the art; see, for instance, Maissel and Glang, Handbook of Thin Film Technology, 1983 Reissue, McGraw-Hill, New York N.Y. Preferred conductive metals are titanium, tungsten, gold and graphite which make good electrical contact with diamond. Graphite, for instance, has a lower sputtering yield and longer lifetime in operation than most metals. As may be seen, conductive metal 22 is deposited over diamond 14 to form a metal layer thereon wherein conductive metal portions 24 cover spikes 16 and conductive metal portions 26 cover valleys 18. Conductive metal 22 preferably forms a uniform metal coating approximately 500 to 3,000 angstroms thick.

Figure 1D:
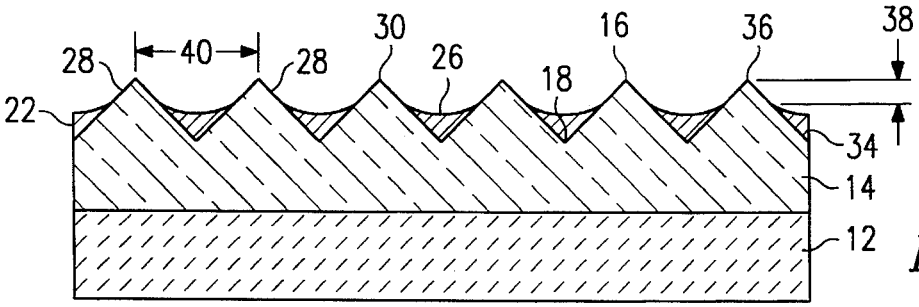

With reference now to FIG. 1D, an etch is applied to remove some but not all of conductive metal 22 in order to expose portions 28 of spikes 16 without exposing valleys 18. The exposed diamond portions 28 serve as raised field emission areas 30. Ion milling is the preferred etch for titanium, tungsten or gold, whereas plasma etching such as by hydrogen plasma is preferred for graphite due to the preferential etching of graphite with respect to diamond. Thus, ion milling, wet etching, plasma etching or a combination thereof may be used depending on the wide band gap material and conductive metal employed. Returning to the example, two important features help assure diamond emission areas 30 are exposed while at least some metal 26 remains to cover valleys 18. First, the sharpness of spikes 16 compared to the flatness of valleys 18 allows metal 24 on spikes 16 to etch at a faster rate than metal 26 on valleys 18. This results in the non-etched metal having a substantially planar top surface 34. Second, conductive metal 22 has a faster etch rate than diamond 14 to assure that the diamond protrudes above the conductive metal 22 after the etch is discontinued. For instance, when 500 electron-volts of argon ions are used for sputter etching, the sputter yield (i.e., for an incoming atom, how many atoms are etched off) of diamond is 0.12 as compared to 0.51 for titanium and 1.18 for chromium.

Endpoint detection may be performed by monitoring the optical emission from the field emitter as etching occurs. For example, bombarding diamond with electrons may produce a blue glow which can be used to indicate that the emission areas are sufficiently exposed at which time the etch can be discontinued. The exact parameters governing endpoint detection depend on factors such as the composition and shape of the wide band gap material, the conductive metal, the type of etch employed, and the desired height of the emission areas. However, for a given application these parameters can be empirically determined by one skilled in the art without undue experimentation.

When the etching is finished, emission areas 30 with peaks 36 protrude above non-etched metal top surface 34 by a height 38 less than the mean free path of electrons in diamond 14 to assure the desired field emission can later occur. That is, as long as the injection surface 34 is closer to the ejection point 36 than the mean free path of electrons in the emission area 30, then statistically the electron emission shall occur due to the ballistic tunneling of electrons through the diamond. Applicant is not aware of the mean free path for electrons in CVD diamond, but estimates the distance to be in the range of 20 to 50 angstroms, which encompasses most materials, and almost certainly in the range of 10 to 100 angstroms. Therefore, vertical distance 38 is preferably no larger than 50 angstroms, more preferably no larger than approximately 20 angstroms, and most preferably no larger than approximately 10 angstroms. The horizontal space 40 between peaks 36 is preferably less than 1 micron, thus providing fine features with high emission area density that are difficult to realize with photolithography based processes.

Figure 1E:
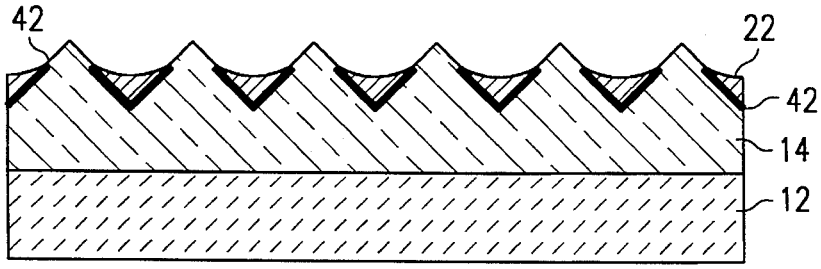

Referring now to FIG. 1E, it is critical that a low resistance electrical connection between the conductive metal 22 and diamond 14 be formed since higher contact resistance generates greater heat during field emission operation. A low resistance electrical contact may arise during the step of depositing metal 22 on diamond 14, particularly if titanium, tungsten or gold is sputter deposited. However, if a low resistance electrical contact is not present, or if a better electrical contact is desired, then an annealing step either before or after the etching step may be advantageous. For instance, field emitter 10 can be subjected to a 400° C. to 500° C. bake for approximately 10 minutes. This forms a 10 angstrom thick alloy 42 of diamond 14 and conductor 22 at the interface therebetween. Alloy 42 assures a low resistance electrical contact between diamond 14 and conductor 22.

Figure 2:
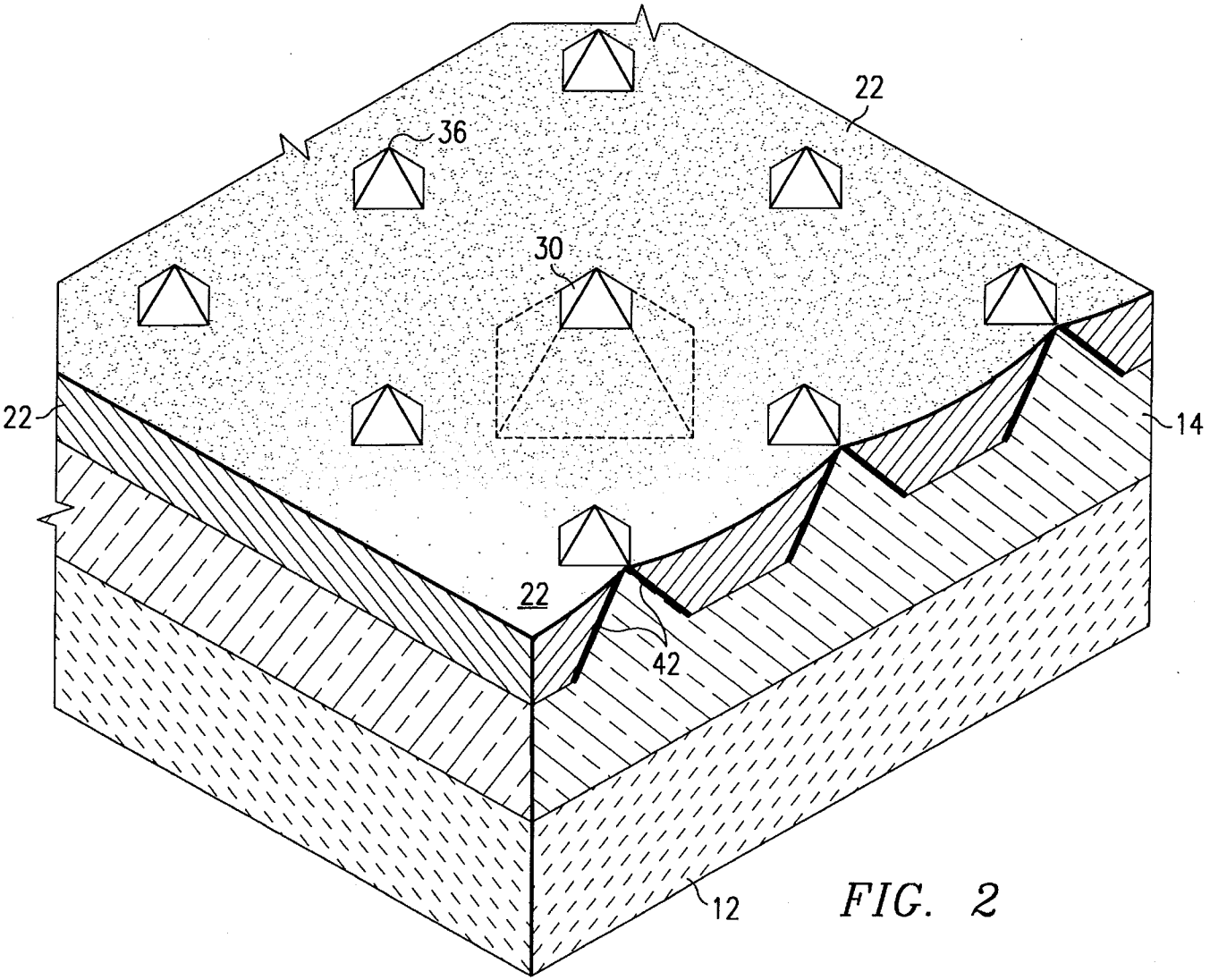
FIG. 2 shows an elevational perspective view of the field emitter of FIGS. 1A–1E, FIGS. 3A–3E show cross-sectional views of successive stages of fabricating a field emitter in accordance with another embodiment of the present invention.

Referring now to FIG. 2, there is seen a perspective view of the field emitter 10 after the fabrication of FIGS. 1A–1E is completed.

Figure 3A:
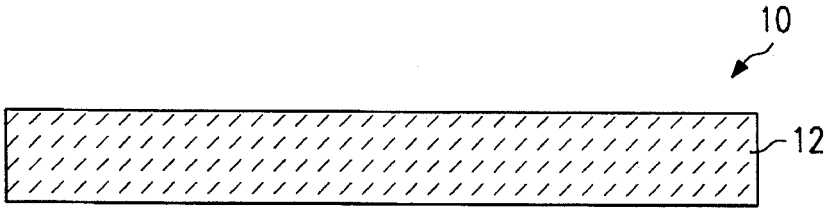

With reference now to FIGS. 3A–3A, there are shown successive cross-sectional views of field emitter 10 according to another embodiment of the invention. In this embodiment, separate particles of diamond are deposited on the substrate. In other respects, this embodiment is similar to the embodiment of FIGS. 1A–1E as previously described.

Figure 3B:
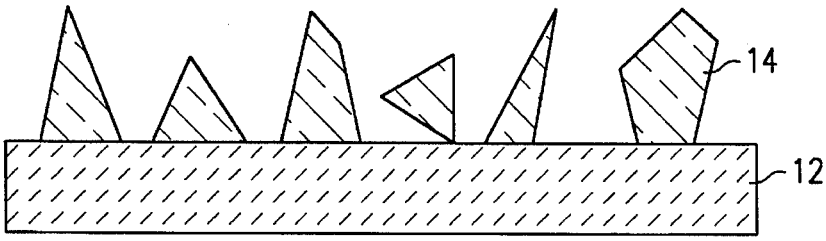
Figure 3C:
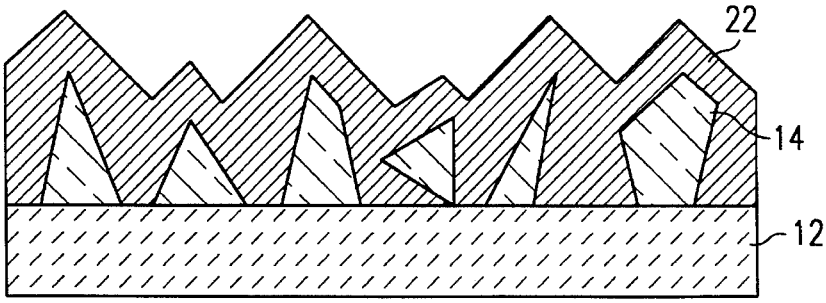
Figure 3D:
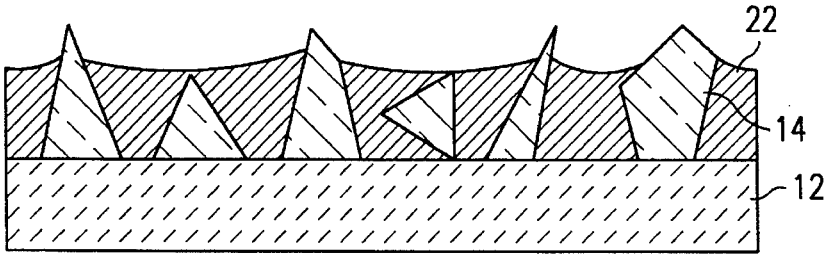
Figure 3E:
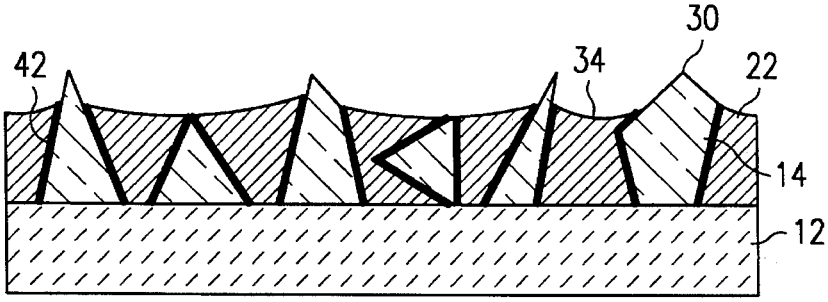

Referring now to FIG. 3A, substrate 12 is provided as previously described. In FIG. 3B, separate spaced particles of diamond 14 (such as diamond powder) are deposited on substrate 12. The size of the particles is preferably in the range of 20 angstroms to 100 microns. It is noted that substantially all the particles of diamond 14 may be spaced from the other particles (as shown), or, alternatively, substantially all the particles may be in contact with the other particles (not shown). In either case, it may be desirable to apply ultrasonic agitation to the substrate in order to more evenly distribute the particles thereby increasing the uniformity of the top surface of diamond 14. In FIG. 3C, a conductive metal is deposited on the diamond particles as previously described. Finally, in FIG. 3D an etch is applied as previously described thereby forming emission areas 30 which protrude above non-etched metal top surface 34, and in FIG. 3E the field emitter is annealed as previously described thereby forming alloy 42 between the diamond and the conductive metal.

Figure 4:
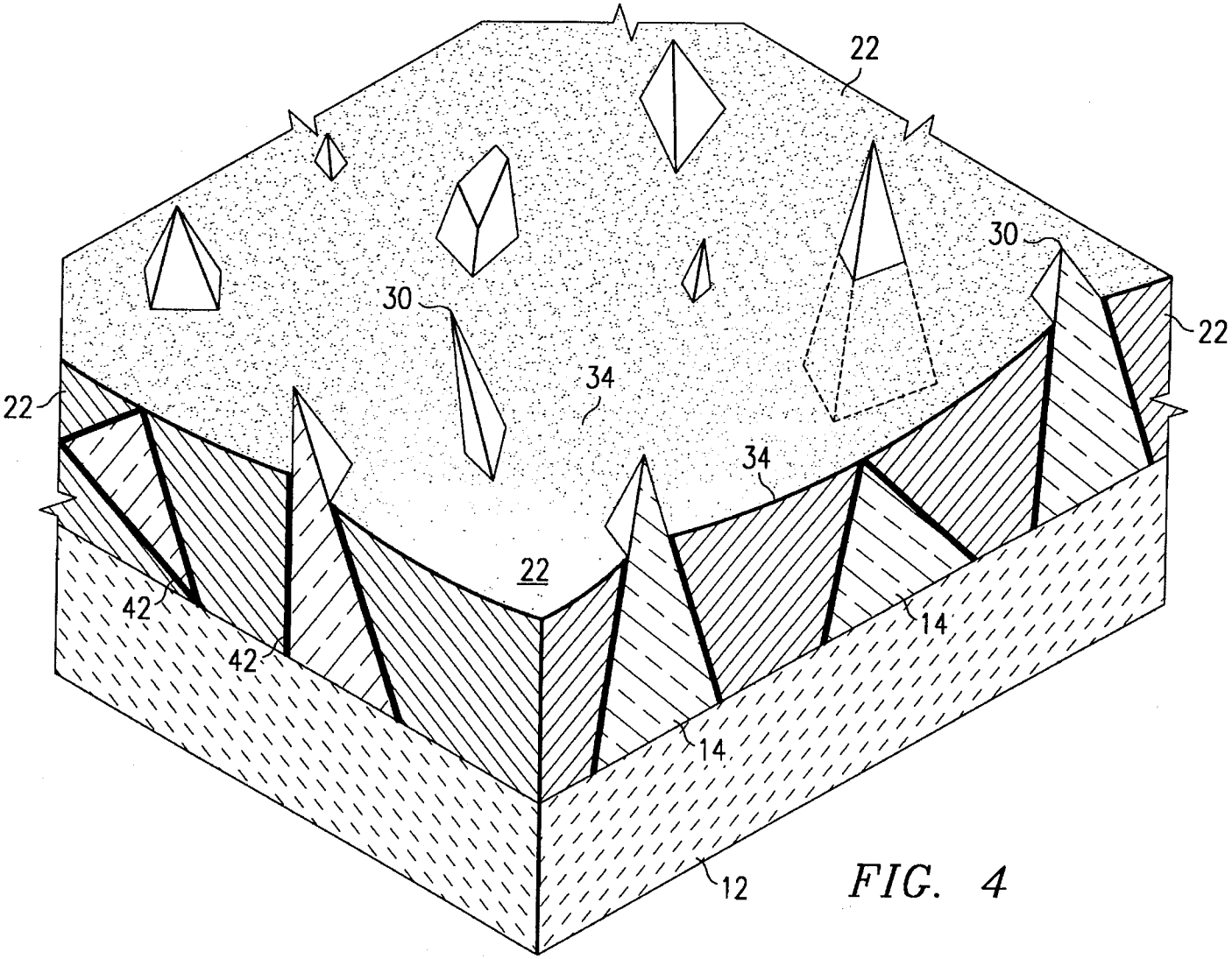
FIG. 4 shows an elevational perspective view of the field emitter of FIGS. 3A–3E, FIGS. 5A–5E show cross-sectional views of successive stages of fabricating a field emitter in accordance with still another embodiment of the present invention.

Referring now to FIG. 4, there is seen a perspective view of the field emitter 10 after the fabrication of FIGS. 3A–3E is completed.

With reference now to FIGS. 5A–5E, there are shown successive cross-sectional views of field emitter 10 according to still another embodiment of the invention. In this embodiment, particles of diamond and conductive metal are mixed with a liquid to form a colloidal solution. The colloidal solution is deposited on the substrate and then the liquid is removed, thereby disposing the diamond and conductive metal on the substrate. In other respects, this embodiment is similar to the embodiment of FIGS. 1A–1E as previously described.

Figure 5A:
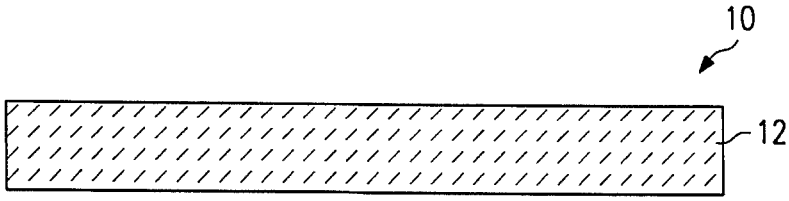
Figure 5B:
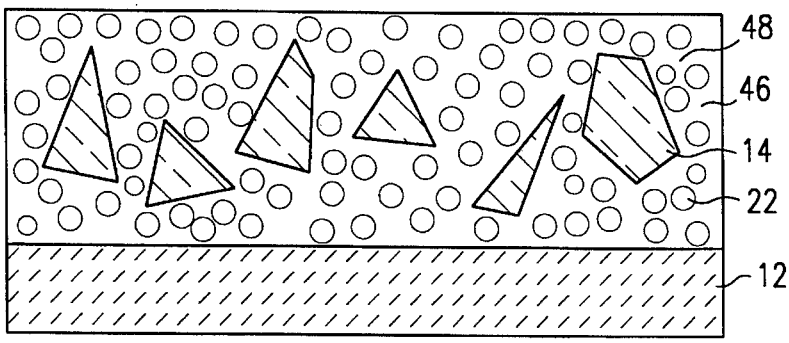
Figure 5C:
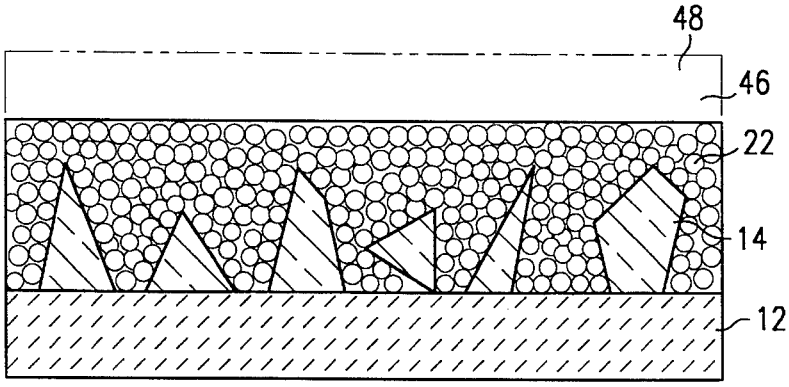
Figure 5D:
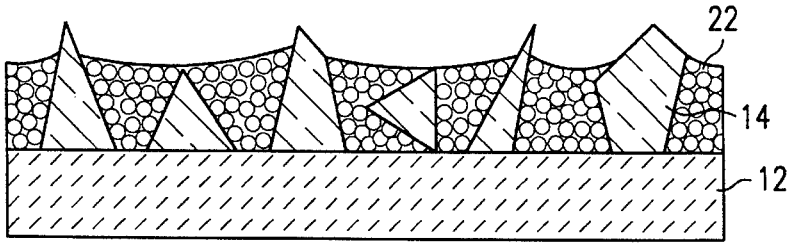
Figure 5E:
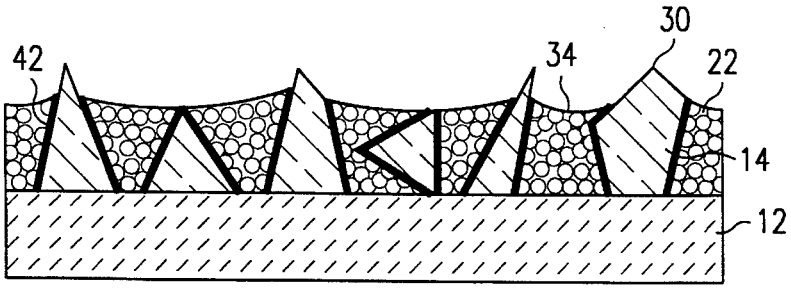

Referring now to FIG. 5A, substrate 12 is provided as previously described. In FIG. 5B, separate spaced particles of diamond 14 (such as diamond powder) are mixed with particles of conductive metal 22 (such as conductive metal powder) in a liquid 46 such as isopropyl alcohol to form a colloidal solution 48 with particles of diamond and conductive metal suspended therein. The size of the diamond particles is preferably in the range of 20 angstroms to 100 microns; the size of the conductive metal particles is also preferably in the range of 20 angstroms to 100 microns. It is noted that particles of diamond 14, particles of conductive metal 22, and liquid 46 may be mixed in any order. For example, particles of diamond 14 can be mixed in an organometallic liquid such as copper hexafluoroacetylacetonate to form colloidal solution 48. In colloidal solution 48 is deposited or coated such as by spin-coating on substrate 12, and the liquid is removed thereby embedding diamond 14 in conductive metal 22. Preferably, liquid 46 is evaporated at a relatively low temperature. For instance, isopropyl alcohol can evaporate at room temperature, and likewise the organic component of an organometallic liquid can often be evaporated at or below 600° C. Evaporating the liquid at a temperature above room temperature may improve the adhesion between the conductive metal and diamond particles and an optional adhesion layer. Finally, in FIG. 5D an etch is applied as previously described thereby forming emission areas 30 which protrude above non-etched metal top surface 34, and in FIG. 5E the field emitter is annealed as previously described thereby fusing the conductive metal particles and forming alloy 42 between the diamond and the conductive metal.

Figure 6:
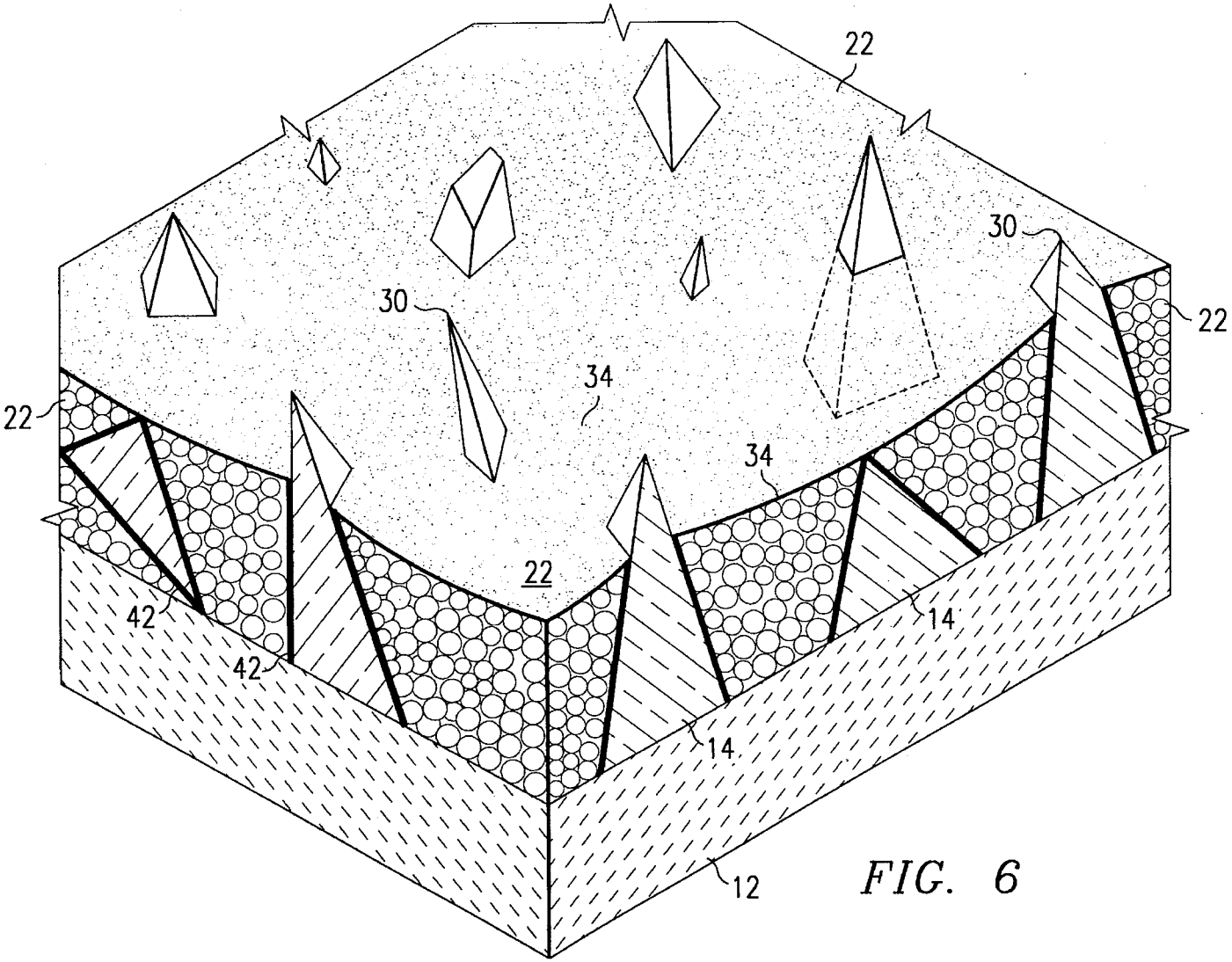
FIG. 6 shows an elevational perspective view of the field emitter of FIGS. 5A–5E.

Referring now to FIG. 6, there is seen a perspective view of the field emitter 10 after the fabrication of FIGS. 5A–5E is completed.

As configured, the emission areas of the present invention can be used in a field emitter device by constructing an anode. The details of anode construction would be apparent to one skilled in the art, see, for instance, U.S. Pat. No. 5,019,003. The emission areas of the present invention are particularly well suited for operation in large area flat panel displays.

Other such possibilities should readily suggest themselves to persons skilled in the art. For example, the emission areas of the present invention may be sharp tips, or relatively flat, as long as they protrude above the conductive metal. The present invention may suitably comprise, consist essentially of or consist of the foregoing materials and process steps.

The present invention, therefore, is well adapted to carry out the objects and attain the ends and advantages mentioned, as well as others inherent therein. While presently preferred embodiments of the present invention have been described for the purpose of disclosure, numerous other changes in the details of construction, arrangement of parts, compositions and materials selection, and processing steps can be carried out without departing from the spirit of the present invention which is intended to be limited only by the scope of the appended claims.

What is claimed is:

1. A method of fabricating a field emitter, comprising the steps of:

disposing a wide band gap material on a substrate;

disposing a conductive metal on the wide band gap material; and etching the conductive metal thereby exposing wide band gap emission areas which contact and protrude from a substantially planar surface of the conductive metal.

2. The method of claim 1 wherein the wide band gap material has a band gap in the range of approximately 2.5 to 7.0 electron-volts.

3. The method of claim 1 wherein the wide band gap material is an insulator.

4. The method of claim 1 wherein the wide band gap material is selected from the group consisting of diamond, aluminum-nitride and gallium-nitride.

5. The method of claim 1 further comprising the steps of depositing the wide band gap material on the substrate, then depositing the conductive metal on the wide band gap material.

6. The method of claim 5 wherein a continuous film of the wide band gap material is deposited on the substrate.

7. The method of claim 5 wherein separate particles of the wide band gap material are deposited on the substrate.

8. The method of claim 7 wherein substantially all the particles of the wide band gap material are in contact with other particles of the wide band gap material.

9. The method of claim 7 wherein substantially all particles of the wide band gap material are spaced from other particles of the wide band gap material.

10. The method of claim 7 further comprising the step of applying ultrasonic agitation to the substrate after depositing the particles of the wide band gap material on the substrate but before depositing the conductive metal on the particles of the wide band gap material thereby increasing the uniformity of an uneven top surface of the wide band gap material.

11. The method of claim 1 further comprising the steps of mixing particles of the wide band gap material and particles of the conductive metal in a liquid to form a colloidal solution, depositing the colloidal solution on the substrate, then removing the solution thereby embedding the wide band gap material in the conductive metal.

12. The method of claim 11 wherein the liquid is isopropyl alcohol.

13. The method of claim 11 wherein the particles of wide band gap material are mixed in an organometallic solution of the particles of the conductive metal and the liquid thereby forming the colloidal solution.

14. The method of claim 1 wherein the conductive metal is selected from the group consisting of titanium, tungsten, gold and graphite.

15. The method of claim 1 wherein the conductive metal is selected from the group consisting of titanium, tungsten and gold and the etching is performed by ion milling.

16. The method of claim 1 wherein the conductive metal is graphite and the etching is performed by plasma etching.

17. The method of claim 1 further comprising the step of annealing the wide band gap material with the conductive metal to form a low resistance electrical contact therebetween.

18. The method of claim 1 further comprising the steps of monitoring optical emission from the wide band gap material as etching occurs and discontinuing the etching in response to changes in the optical emission.

19. The method of claim 1 wherein the emission areas protrude a height above the conductive metal less than the mean free path of electrons in the wide band gap material.

20. The method of claim 19 wherein the height is in the range of approximately 10 to 100 angstroms.

21. The method of claim 1 further comprising the step of applying a voltage to the conductive metal to force electrons in the conductive metal to ballistically tunnel through the emission areas thereby causing field emission from the emission areas.

22. The method of claim 21 wherein the voltage is no greater than 5 volts.

* * * * *